US005980672A

United States Patent [19]

Ryan

[11] Patent Number: 5,980,672

[45] Date of Patent: Nov. 9, 1999

[54] LINEAR BAMBOO FIBER CORE FOR FILAMENT WINDING APPLICATIONS

[76] Inventor: Dale B. Ryan, 1001 Chalkstone Dr., Mitchell, S. Dak. 57301

[21] Appl. No.: 08/907,627

[22] Filed: Aug. 8, 1997

Related U.S. Application Data

[63] Continuation-in-part of application No. 08/714,420, Sep. 16, 1996, abandoned.

[51] Int. Cl.[6] ..... B65H 81/00

[52] U.S. Cl. ..... 156/169; 156/172; 156/173; 156/175

[58] Field of Search ..... 156/169, 172, 156/173, 175, 425

[56] References Cited

FOREIGN PATENT DOCUMENTS 46-40741 12/1971 Japan ..... 156/169

*Primary Examiner*—Jeff H. Aftergut
*Attorney, Agent, or Firm*—Richard L. Huff

[57] ABSTRACT

A linear bamboo tape containing a series of adhesively connected bamboo sections wherein each section has a predetermined width and thickness. The tapes are made by splitting cut and dried bamboo culms to obtain bamboo sections, sizing the bamboo sections to the desired width and thickness, adhesively connecting the treated sections, and applying a binder having excellent holding properties. The bamboo tape is used to make cylindrical containers or load-bearing structures by treating the tape with a resin and applying the treated tape to a surface of a cylinder to form a strong, lightweight, inexpensive cylinder. A cosmetic surface can be applied to the formed cylinder. The binder/bamboo tape can also be applied to the outer surface of cylindrical forms and treated with polymers to form pipes and tubes.

12 Claims, 5 Drawing Sheets

LINEAR BAMBOO FIBER CORE FOR FILAMENT WINDING APPLICATIONS

CROSS-REFERENCE TO RELATED APPLICATIONS

This application is a continuation-in-part of application Ser. No. 08/714,420 filed Sep. 16, 1996, now abandoned.

BACKGROUND OF THE INVENTION

1. Field of the Invention

This invention relates to linear bamboo fibers, processes of preparing them, and processes of using them as structural cores in circumferentially wound vessels such as pipes and tanks and solid load-bearing structures such as utility poles, pilings, and columns.

2. Description of the Related Art

Conventional pipes made of clay or iron have relatively short life spans. Clay and iron have been replaced by, stronger and longer-lasting fiberglass products.

Hollow, wound products such as pipes and tanks are currently manufactured by pulling glass fibers which have been treated in a resin bath around rotating mandrels. The resulting product can be of greatly varying diameters and capable of withstanding substantial internal pressures. Very large amounts of pressure pipes are used throughout the world for drinking water, oil pipelines, waste water, sewage, and natural gas. Solid, uncored composite pipe is very heavy and quite expensive. These disadvantages become more apparent in the manufacture of large storage tanks, which may be over 100 feet in diameter due to their relatively thick wall cross-sections.

The prior art is aware of coating bamboo poles with plastic. Thus, U.S. Pat. No. 4,774,906 teaches a process for coating bamboo poles with plastics in order to protect and improve the appearance of the poles. No utility is proposed for the resulting polymer-coated bamboo poles and this patent fails to disclose pretreating the bamboo poles with a binder to improve the adhesion of the polymer to the bamboo poles.

SUMMARY OF THE INVENTION

The present invention seeks to overcome the disadvantages inherent in the prior art materials by providing a low-cost tape or roving which may be wound around cores to form solid structures such as load-bearing structures, e.g., utility poles, piles, and columns and hollow vessels, e.g., pipes and tanks while meeting or exceeding the performance and strength characteristics of the existing products.

The present invention discloses a method of treating bamboo fibers processed into tape or roving which will allow the fibers to be circumferentially wound as fiberglass is wound in the prior art. The bamboo material of the present invention, when treated with a binder recited in this specification, is compatible with thermoplastic or thermosetting resins. This treatment prevents slippage between the bamboo fibers and the polymers.

The manufacturing operation of the present invention can be carried out in factories when pipes or small vessels or load-bearing structures are being manufactured. Alternatively, the fibrous product of the present invention can be transported to the site of construction for the manufacture of large storage tanks, structural columns, or other large structures.

DESCRIPTION OF THE PREFERRED EMBODIMENTS

Figure 1:
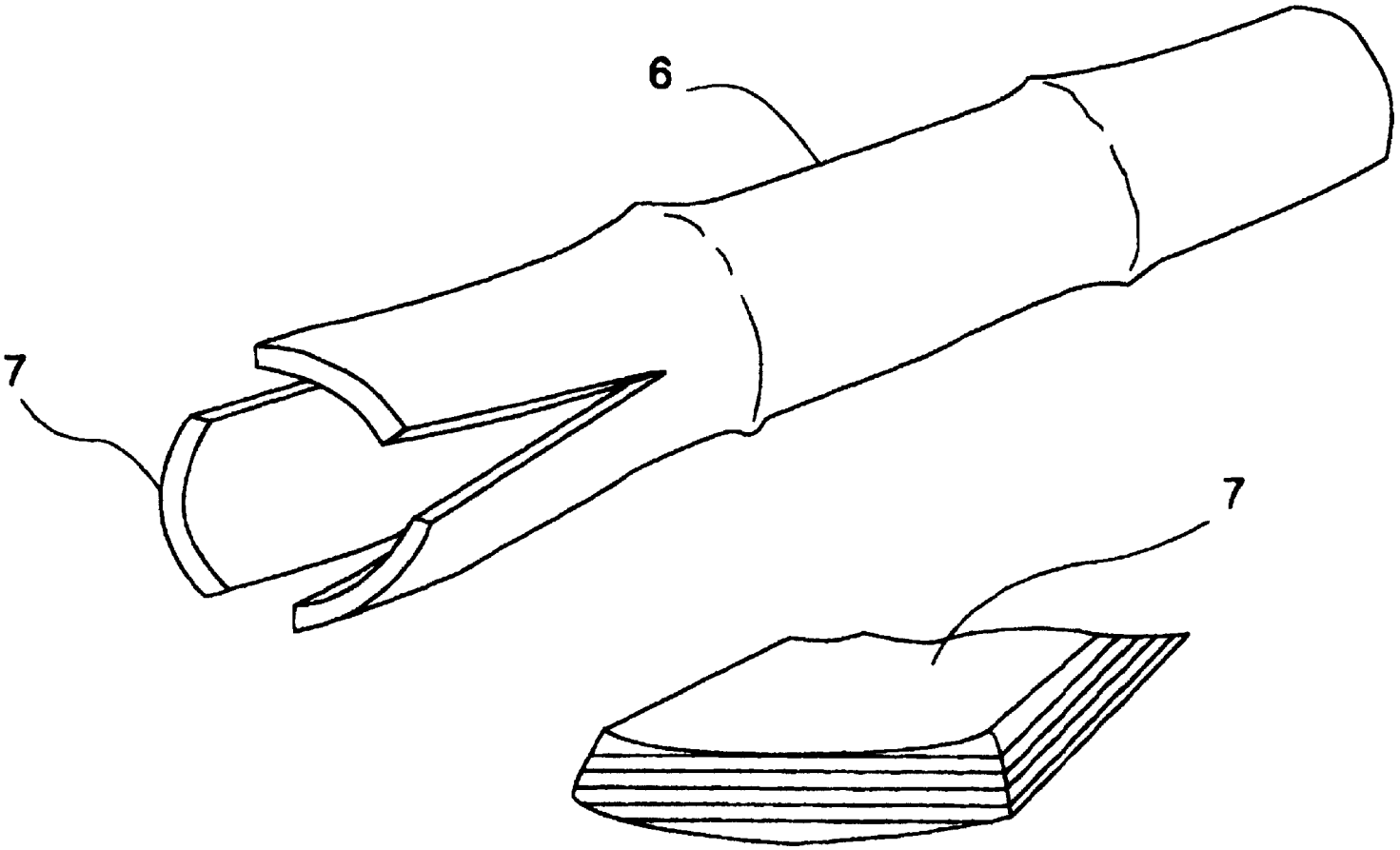
FIG. 1 is an elevational view of a bamboo culm split into the proper width to produce a linear, unidirectional tape product and the tape product.
Figure 2:
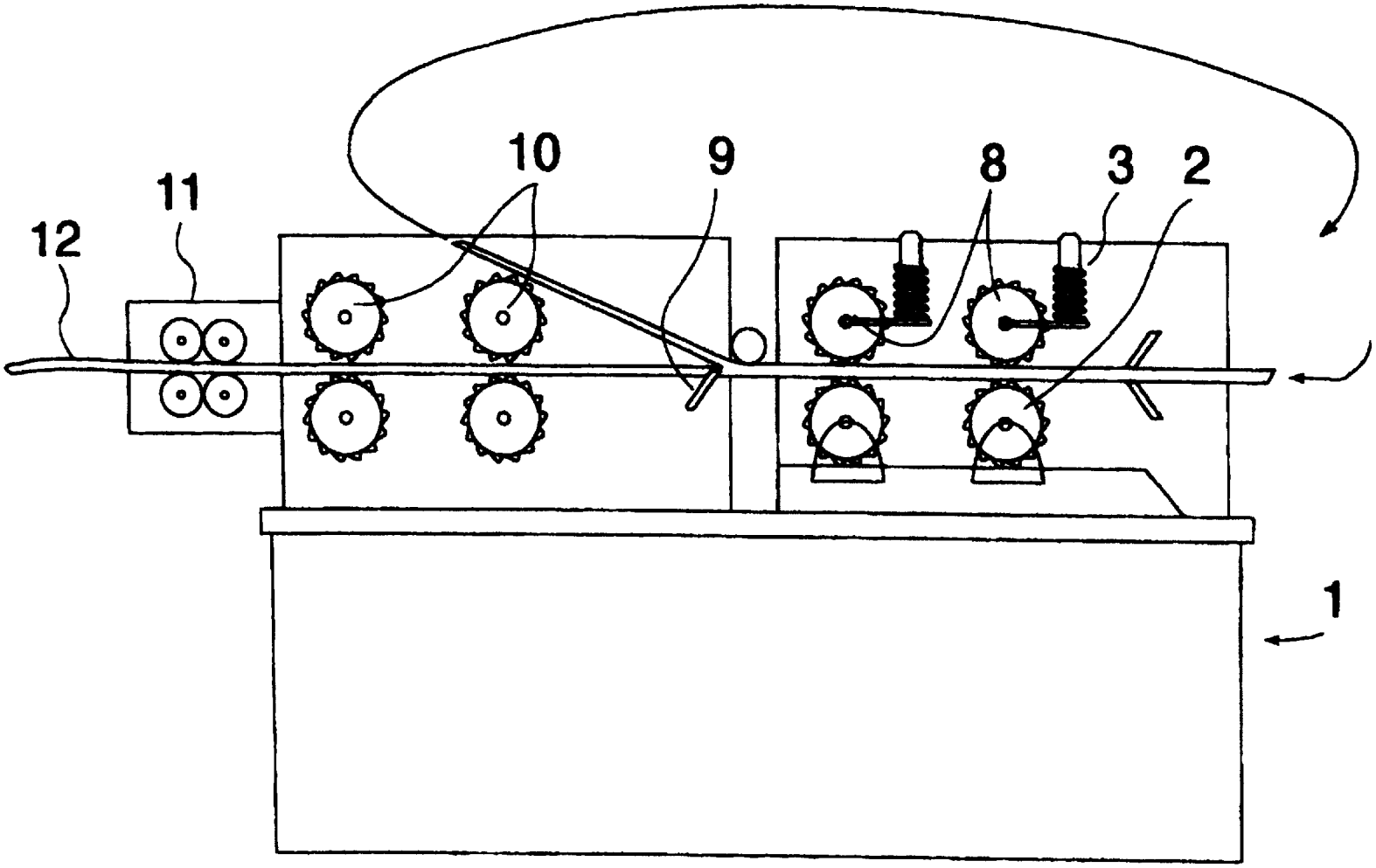
FIG. 2 is a side elevational view of a tape-producing machine used in the present invention.

The invention will now be described with reference to the above Figures, wherein like numerals refer to like features.

Bamboo is cut and dried to the optimum moisture content, to produce a culm 6 useful for the present invention. The culm 6 is split to form a split bamboo section 7 having the proper width indicated by the final tape width necessary. The split bamboo section 7 is then processed in a tape slicing machine 1 which shaves the sections to a predetermined thickness allowing it to be flexible enough to be wound around a forming mandrel. The tape splicing machine 1 is capable of accommodating many various bamboo split section 7 widths and is able to produce tape lengths 12 of any practical thickness.

The tape slicing machine 1 contains a plurality of pairs of upper 8 and lower 2 drive gears. The upper drive gear 8 floats under the lifting force of springs 3 to accommodate the bumps and other variations in the split bamboo sections 7. The tape slicing machine 1 contains an adjustable blade 9 which is capable of shaving the tape length 12 to the desired thickness. The tape slicing machine 1 further contains take-up gears 10 that push the final tape length 12 out of the machine 1 and enable the looping around of the split section 7 for another pass through the machine 1.

A coating apparatus 11 is on or near the machine 1. The coating apparatus 11 coats the tape length 12 with at least one of the binders recited above, preferably acrylic acid or maleic anhydride salt or ester derivatives. The coating may be done by any conventional method, including spraying, dipping, or roller painting. The binder promotes interfacial bonding of the tape 15 with the polymer matrix.

Figure 3:
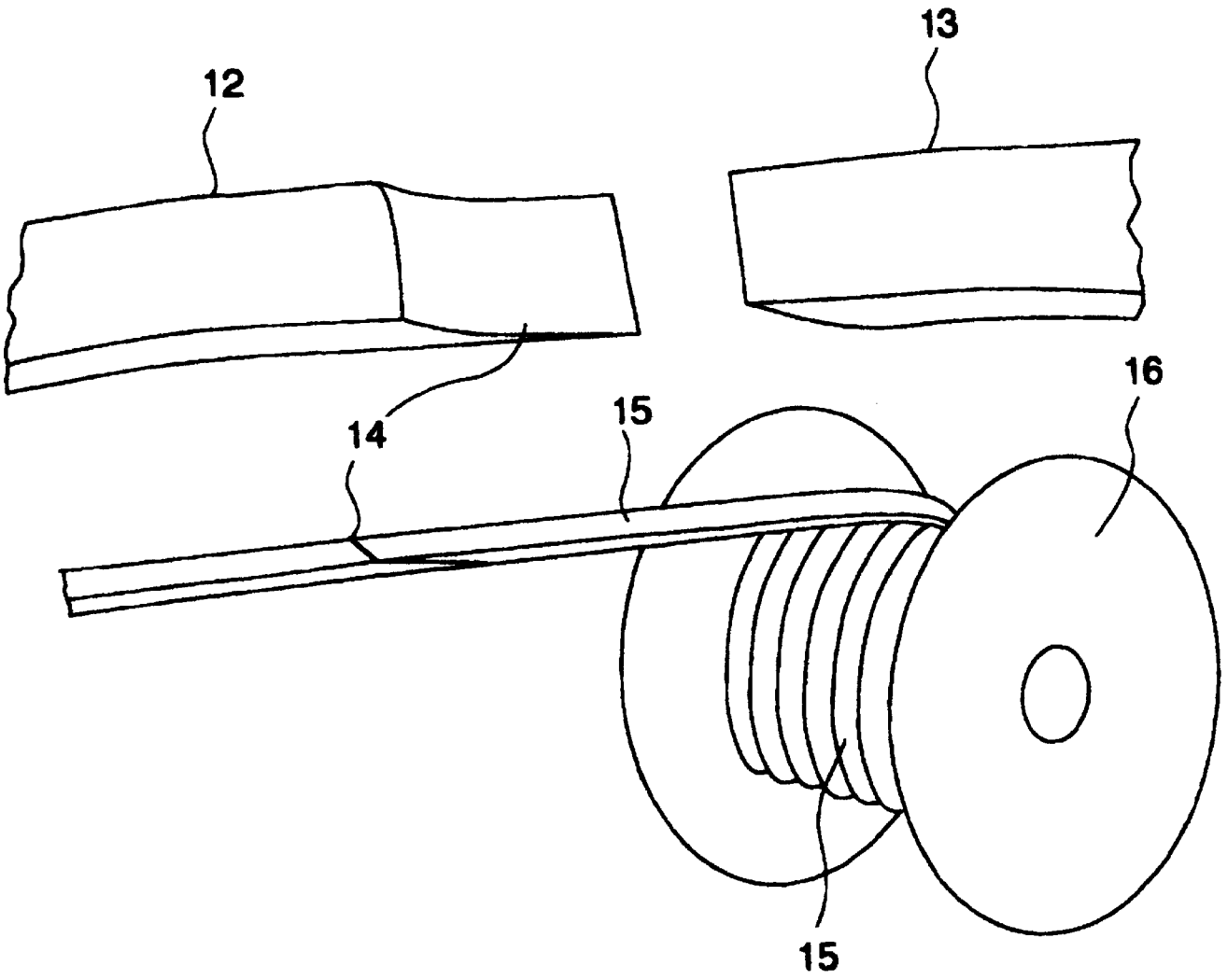
FIG. 3 is an schematic representation showing one end of a tape length connected to another to produce a reel of tape.
Figure 4:
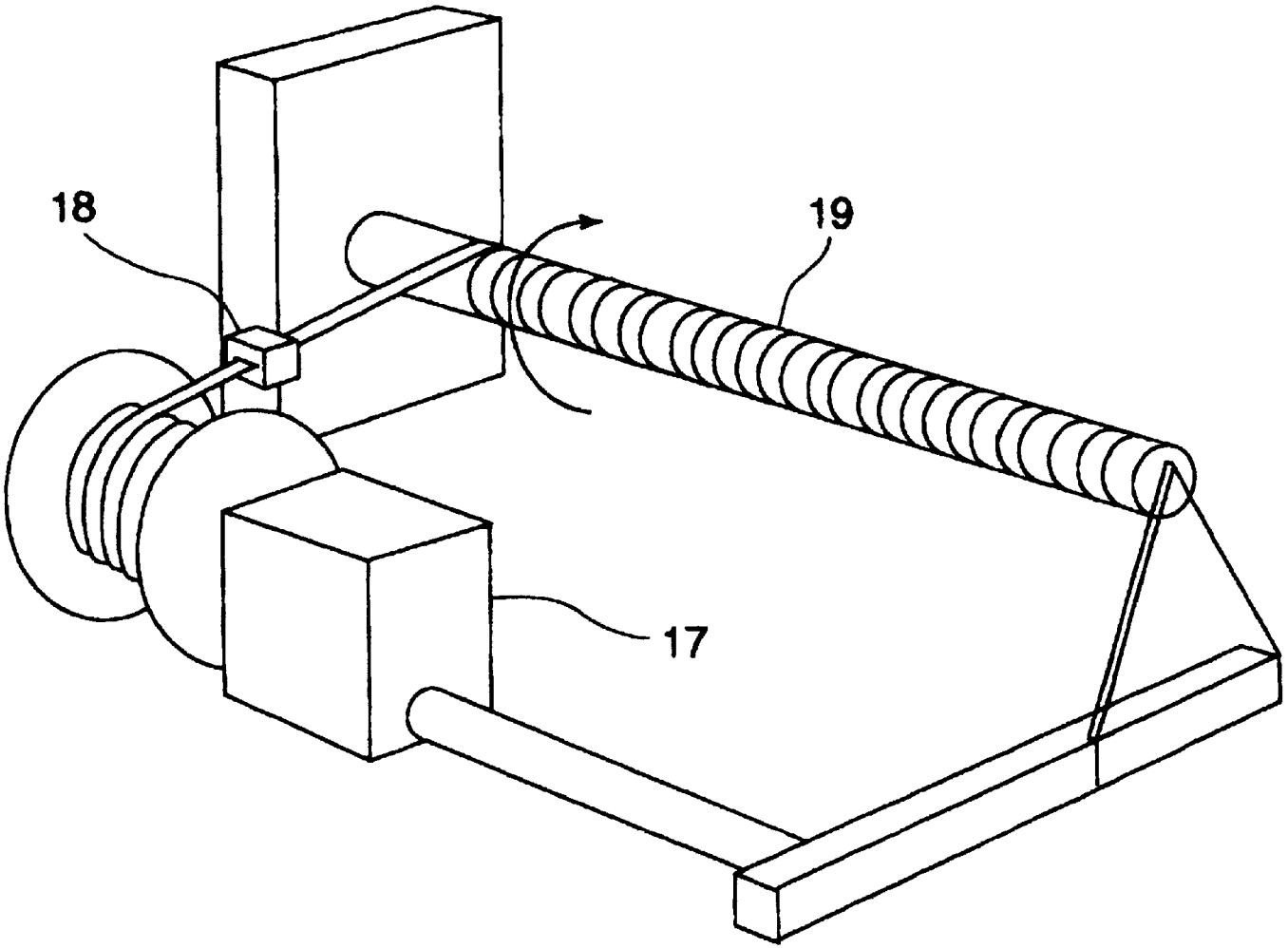
FIG. 4. is an elevational view of a pipe-winding machine which is used to wind bamboo linear fiber upon a pipe-forming mandrel.

Following removal of a tape length 12 from the tape slicing machine 1, the end of one tape length 12 is joined to the end of another tape length 13. This operation is repeated a plurality of times in order to form a long tape 15 having a desired length. Preferably, joining is accomplished by first feathering the ends to be joined as shown in FIG. 3. Then, an adhesive 14, such as hot melt glue or a quick-drying epoxy cement is applied to at least one feathered end and the two ends are brought into contact. The rapidity of the setting of the adhesive allows the resulting tape 15 of uninterrupted linear bamboo fiber to be taken onto a spool 16 without stopping the manufacturing process. In this way, sufficient tape 15 can be produced to continuously wind various products, such as tanks or pipes.

Uninterrupted linear bamboo fibers in the form of roving can be produced by using narrow pieces of split bamboo sections 7 and twisting a plurality of such sections together to form a roving, which is then taken up on a reel 16. This process is within the skill of the art.

In accordance with the present invention, a high tensile strength core comprising linear bamboo fibers processed into tape or roving will allow the fibers to be circumferentially wound as fiberglass is wound in the prior art. The material of the present invention, when treated with a binder, is compatible with thermoplastic or thermosetting resins. This treatment prevents slippage between the bamboo fibers and the polymers.

It has been discovered that excellent binding results are obtained by using the following binding agents: maleated polypropylene, maleated polyethylene, maleic anhydride, hydroxyl methacrylate, N-vinyl pyridine, silane compounds, N-vinyl caprolactam, N-vinyl carbazole, methacrylic acid, ethyl methacrylate, isobutyl methacrylate, sodium styrene sulfonate, bis-vinyl phosphate, divinyl ether-ethylene glycol, vinyl acetate, vinyl toluene, vinylidene chloride, chloroprene, isoprene, dimethylaminoethyl methacrylate, isocetylvinyl ether, acrylonitrile, glycidyl methacrylate, N-vinyl pyrrolidone, acrylic acid, ethyl acrylate, itaconic acid, methyl acrylate, sodium vinyl sulfonate, cetyl vinyl ether, divinyl ether-butanediol, and octadecyl vinyl acetate.

For use in manufacturing a cylinder, a reel 16 of binder-treated bamboo tape 15 or roving is mounted on a carrier 17 or filament winder. The linear bamboo tape 15 or roving is unwound from the reel 16 and pulled through a bath 18 of polymer. Any thermosetting or thermoplastic resin useful in the fiberglass art is satisfactory in the process of the present invention. The treated linear bamboo fiber is then wound upon a mandrel 19 to form a bamboo/resin cylinder which may then be separated from the mandrel.

In the formation of pipe or hollow poles, a single layer of fiberglass is wound on the mandrel 19 to form an interior working surface. Then, the binder/resin-treated bamboo fiber of this invention is wound onto the fiberglass followed by the winding of a single layer of a fiberglass outer surface. In such a way, a cylinder having a wall cross-section of 5% inner layer of resin-treated fiberglass, 90% core of resin-treated bamboo fiber, and 5% outer layer of resin-treated fiberglass is manufactured. This cylinder may then be removed from the mandrel. The final thickness and composition of the cylinder sidewall determines the pressure resisting strength, the weight-per-foot, and the outside diameter of the cylinder. One configuration of a cylinder suitable for a pipe is a cylinder with a sidewall thickness of one inch consisting of a one-eighth inch thick resin-treated fiberglass interior surface, a three-quarter inch thick resin-treated linear bamboo fiber core, and a one-eighth inch thick resin-treated fiberglass outer cosmetic surface. This pipe is equal in strength to a solid fiberglass pipe and is manufactured at a fraction of the cost of the fiberglass pipe.

Storage tanks are produced in a similar manner with various types of liners and outer surfaces, or even 100% resin-treated bamboo fiber construction.

Figure 5:
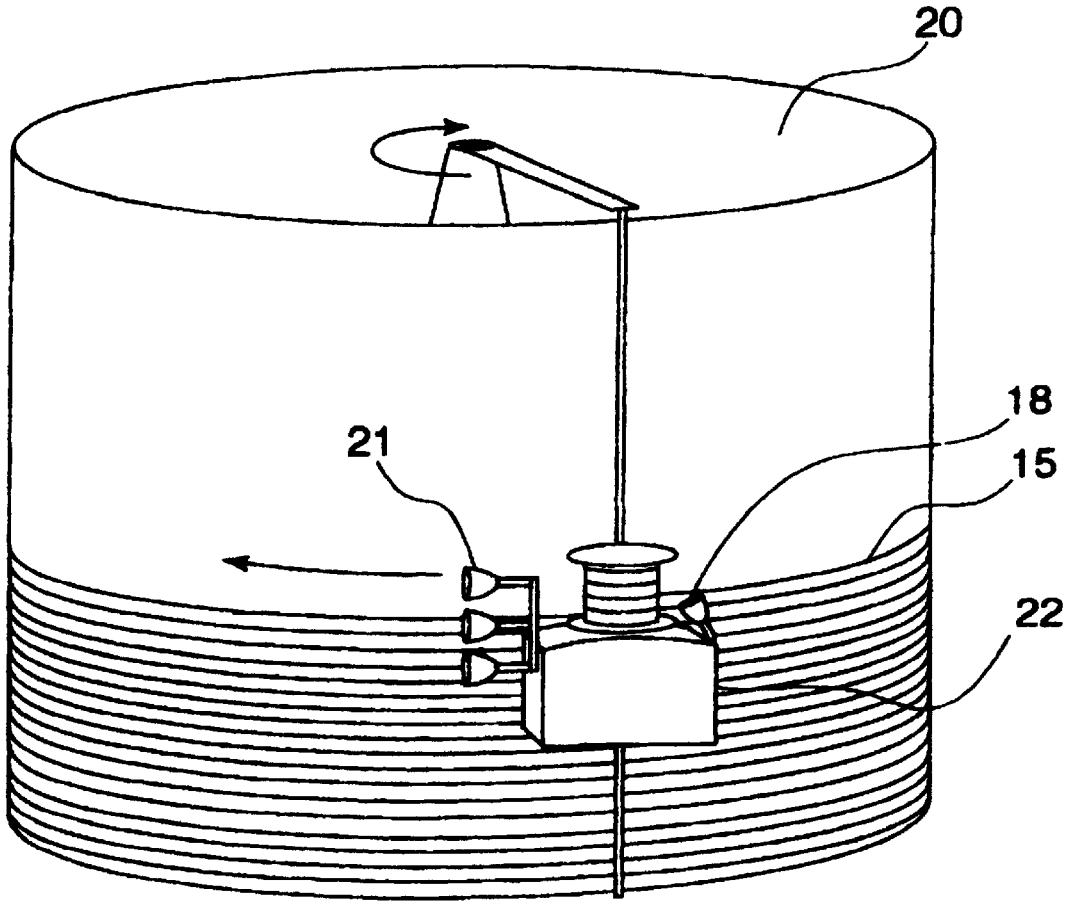
FIG. 5 is an elevational view of a storage tank showing on-site winding of bamboo linear tape and a sprayer for preparing an outer surface coating.

Larger storage tanks may be manufactured on site by a method illustrated in FIG. 5. A self-contained winding machine 22 travels around the exterior of a pre-form 20, paying out the binder-treated linear bamboo tape 15 through a resin bath 18 so that the resin-treated tape 15 is tightly wound on the pre-form 20. The interior surface of the pre-form 20 is then treated with a liner which will be left in the tank upon completion.

Alternatively, the exterior surface of the pre-form 20 is wound by linear bamboo tape 15 which has been treated with a binder, and this resulting surface is treated, preferably by spraying using the spraying apparatus 21, with a resin. The pre-form may be removed to leave a free-standing bamboo/resin storage tank. To enhance the visual appearance and longevity, a gel coat or acrylic coat may be applied to the resin-treated bamboo fiber surface. As another alternative, only the resin-treated linear bamboo fiber is applied to the pre-form. The pre-form may be left in place or removed. A storage tank constructed in this manner is made at a much lower cost than one using steel, concrete, or fiberglass.

This invention dramatically lowers the cost of composite pipes, poles, pilings, and tanks, while retaining all of the superior properties. This allows the widespread use of composite tanks, poles, pilings, and pipes in countries where their cost is now prohibitive. Some of the most economically disadvantaged countries in the Pacific Rim, and in Central and South America already have the highest quality bamboo fiber. Thus, raising bamboo as a structural fiber cash crop would prove an excellent alternative to rainforest slash-and-burn agriculture techniques.

I claim:

1. A process for preparing a cylinder, which comprises:

(a) unwinding a linear bamboo tape from a reel, which linear bamboo tape comprises a series of adhesively connected bamboo sections, each section being of a predetermined width and thickness, and wherein the tape is coated with a binder, (b) passing the tape through a resin bath containing a resin to coat the tape with the resin, and (c) applying the tape to an inner or outer surface of a predetermined material in cylindrical form to produce a layer of predetermined material and a layer comprising resin-coated bamboo tape.

2. The process of claim 1, wherein the binder is at least one member selected from the group consisting of maleated polypropylene, maleated polyethylene, maleic anhydride, hydroxyl methacrylate, silane compounds, N-vinyl pyridine, N-vinyl caprolactam, N-vinyl carbazole, methacrylic acid, ethyl methacrylate, isobutyl methacrylate, sodium styrene sulfonate, bis-vinyl phosphate, divinyl ether-ethylene glycol, vinyl acetate, vinyl toluene, vinylidene chloride, chloroprene, isoprene, dimethylaminoethyl methacrylate, isocetylvinyl ether, acrylonitrile, glycidyl methacrylate, N-vinyl pyrrolidone, acrylic acid, ethyl acrylate, itaconic acid, methyl acrylate, sodium vinyl sulfonate, cetyl vinyl ether, divinyl etherbutanediol, and octadecyl vinyl acetate.

3. The process of claim 1, which comprises the additional step (d), which is:

(d) applying a predetermined cosmetic outer surface to the layer comprising resin-coated bamboo tape.

4. The process of claim 1, wherein the predetermined material comprises a glass/resin composition in filament form wound around a mandrel.

5. The process of claim 3, wherein the cosmetic outer surface comprises a glass/resin composition.

6. The process of claim 3, wherein the cosmetic outer surface is applied by winding glass/resin fibers.

7. The process of claim 3, wherein the cosmetic outer surface is applied by spraying a resin coat.

8. The process of claim 1, wherein the linear bamboo tape is wound directly upon a liner which will form part of the cylinder.

9. The process of claim 3, wherein the cylindrical form is removed following step (d).

10. The process of claim 1, wherein the cylinder is a storage tank.

11. The process of claim 1, wherein the cylinder is a pipe.

12. The process of claim 1, wherein the binder is acrylic acid.

* * * * *